US008607869B2

(12) United States Patent
Soucy

(10) Patent No.: US 8,607,869 B2
(45) Date of Patent: Dec. 17, 2013

(54) LINEAR PRESSURE REDUCER FOR REGULATING INJECTION PRESSURE IN AN ENHANCED OIL RECOVERY SYSTEM

(75) Inventor: Brian A. Soucy, Canton, GA (US)

(73) Assignee: Global Environmental Solutions, Inc., Marietta, GA (US)

( * ) Notice: Subject to any disclaimer, the term of this patent is extended or adjusted under 35 U.S.C. 154(b) by 235 days.

(21) Appl. No.: 13/112,722

(22) Filed: May 20, 2011

(65) Prior Publication Data

US 2012/0292029 A1 Nov. 22, 2012

(51) Int. Cl.
*E21B 34/02* (2006.01)
*E21B 43/18* (2006.01)

(52) U.S. Cl.
USPC ..... 166/305.1; 166/316

(58) Field of Classification Search
USPC ..... 166/305.1, 316
See application file for complete search history.

(56) References Cited

U.S. PATENT DOCUMENTS 6,491,816 B2 * 12/2002 Petro ..... 506/43
2012/0205099 A1 * 8/2012 Briechle et al. ..... 166/270.1

* cited by examiner

*Primary Examiner* — William P Neuder
(74) *Attorney, Agent, or Firm* — Young & Thompson

(57) ABSTRACT

Linear pressure reducer apparatus for regulating injection pressure of a water-soluble polymer solution in injection wellheads, in an enhanced oil recovery system, including modules connected in series to the main injection pipe and each consisting of tubes of identical diameter but variable length, the apparatus allows variations to be made to pressure drop by adjusting the length of the tube through which the solution flows by closing or opening modules, without substantial degradation to the viscosity of the solution during its passage through the module. Installation for enhanced oil recovery implementing the apparatus.

8 Claims, 2 Drawing Sheets

Figure 1 - Polymer degradation FP 3630S (AM/AA - 1000 ppm) - pressure drop in a choq - flow rate 80m3
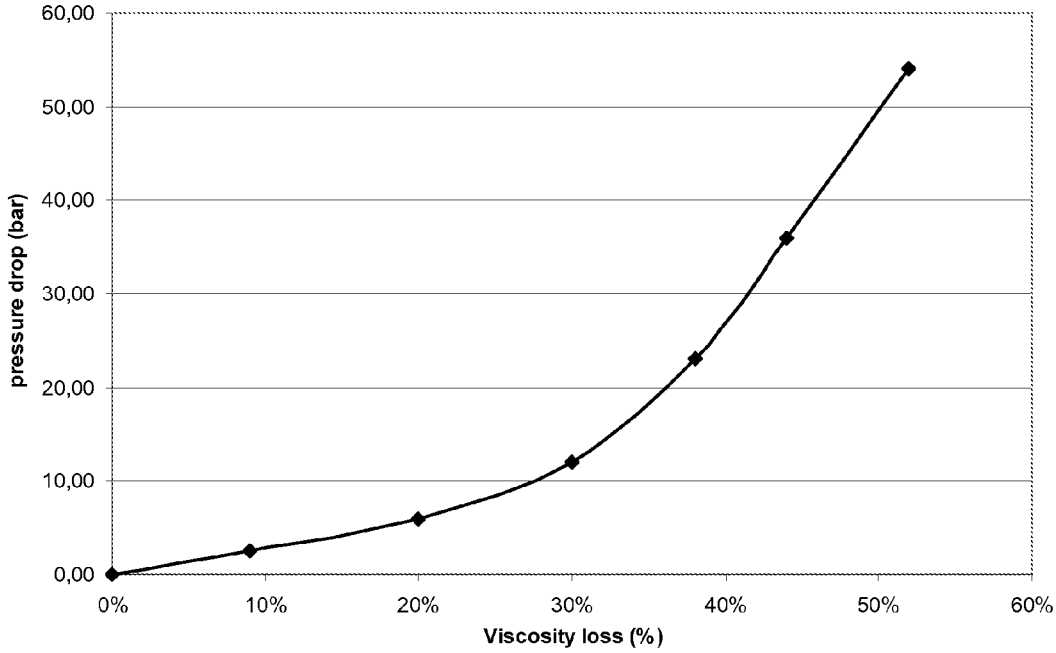
Figure 2
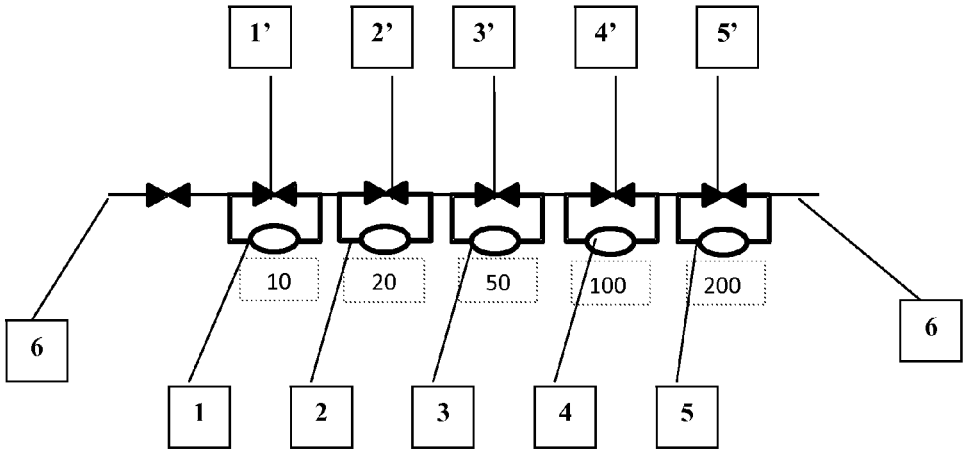

LINEAR PRESSURE REDUCER FOR REGULATING INJECTION PRESSURE IN AN ENHANCED OIL RECOVERY SYSTEM

The invention is a linear pressure reducer for regulating injection pressure in injection wellheads in an enhanced oil recovery system. Another object of the invention is an enhanced oil recovery system that implements the aforementioned linear pressure reducer.

In the oil extraction industry, primary production obtains oil by using reservoir pressure.

In secondary production, reservoir pressure is maintained by injecting pressurised water.

In the 1970s, the use of enhanced oil recovery (EOR) using a polymer began, where the water injected is made viscous by the addition of water-soluble polymers so as to widen the injection bulb, increase reservoir sweep and recover more oil in position, by physical effect. The polymers used are:

Either natural: xanthan gum, guar gum, cellulose derivatives,

Or synthetic: polyacrylamide, polyacrylates, polyvinylpyrrolidone . . .

In practice, where a single polymer injection pump is used to feed several wells at different pressures, it must simultaneously:

pump at a determined rate so as to maintain sufficient pressure in all wells, reduce pressure in certain wells so as not to fracture them, adapt the torque pressure/rate to the selected injection plan.

The feed pump is usually set to a pressure of 20 bar above the pressure of the well with the highest pressure.

Each well contains a pressure reducing valve called a choke in its wellhead, which allows control over the injection pressure and the water flow rate into each well. The pressure of the wells varies according to multiple factors: reaction to the injection, the salinity of the injected solution, the effect of filtering impurities . . . .The choke allows the injection pressure to be reduced to the desired pressure at any time, with a different regulator for each well.

One of the main problems, in the case of enhanced oil recovery, is the mechanical degradation that the polymer undergoes due to the variation in desired pressure created by the choke, this variation corresponds in general to a pressure drop of 10-50 bar. As the polymer degrades, the chokes significantly reduce the viscosity of the solution to be injected, thus limiting oil recovery.

Studies carried out into the mechanical degradation of polymers in solution are all empirical due to the drag, or friction, reduction effect, which has not been scientifically evaluated in a non-Newtonian system.

The figures available for loss of pressure, flow, speed and degradation are therefore very disparate.

It was found that degradation in the valves of piston or diaphragm pumps begins at speeds of 3 meters per second.

In standard chokes, which either have a single opening with limited precision, or multiple openings rotary ones (Cameron) with a low diameter of holes, degradation starts very early, at differences in pressure of 5 bar while, as mentioned above, they most frequently work with a pressure drop of 10 to 50 bar, especially in offshore application (see FIG. 1). There is therefore an adjustment flow rate with variable but significant degradation, as extremely high decompression forces cause cavitation effects that are practically explosive.

Loss of viscosity is then directly linked to pressure drop through the choke and the diameter of the openings. Typically, for a rotary choke, degradation is roughly linear up until 20 bar of pressure drop and can be compensated by increasing the concentration of the polymer. Beyond 20 bar, degradation accelerates.

For example, a choke with pressure drop of 40 bar reduces the viscosity of a polyacrylamide solution by an average of 50%.

This phenomenon becomes extremely important in offshore operations where chokes on the seabed feed several injectors with pressure reductions, sometimes exceeding 50 bar. On inshore installation this problem is usually solved by feeding each well separately from a central polymer dissolution station. In this case the polymer is dissolved at high concentrations (5-20 g/liter) and injected at high pressure by volumetric pump into the controlled flow of water into each well. The choke is located before the injection of the polymer, which is then protected from mechanical degradation.

The dissolution station may be:

centralised with a water-polymer mix made at the polymer preparation station and transported via pipeline to each well, it can also be distributed with two water-polymer circuits that circle the reservoir and injectors and with a choke for the water, then a localised polymer pump for the wells.

The two solutions are virtually equivalent in terms of cost.

A third solution that has been tested with little success is cyclic injection. With a group of wells, the solution is injected into a single well at a time, and in cycles. When the injection finishes, the pressure progressively decreases then to increase once more for the following injection cycle at a pressure inferior to the fracturing pressure. This complex and efficiency is low.

The market is therefore lacking a device that reduces pressure, even at very high values, without degrading the polymer. More precisely, the aim is to develop a device that can regulate injection pressure with respect to the evolution of well pressure which varies, as we have already discussed, depending on multiple factors, all at high speed, with no substantial degradation of the polymer.

Tests were conducted using tubes of short length (6-12 meters) and reduced section. Nonetheless, degradation of viscosity was still observed, meaning the system cannot be used commercially beyond a few bars of pressure drop.

The Applicant has ascertained that it is possible to reduce pressure without notably affecting the viscosity of the polymer and this when using, despite the high injection speeds, tubes with lengths greater than 100 meters, from approximately 100 to 500 meters to be specific.

Based on this finding and to solve the problem of regulating injection pressure as a function of well pressure, without substantially affecting the viscosity of the injection solution and at high injection flow rates, the Applicant has developed a linear pressure reducer device, composed of tubes of different lengths and giving variable pressure drops without an substantial degradation in fluid viscosity.

To be more precise, the object of the invention is a linear pressure reducer that will regulate the injection pressure of a water-soluble polymer solution in the wellhead of an injection well, during enhanced oil recovery.

The reducer device consists of modules connected in series to the main pipe, each consisting of a tube of the same diameter but with variable length, said device allowing pressure drop to be varied by adjusting the length of the tube through which the solution flows, by opening or closing modules, without substantial degradation of the solution viscosity during its passage through the module.

In practice, when the recommended injection rate and composition of the injection solution are known, tests can determine the tube diameter and length needed to obtain the desired range of pressure reduction. This length is then cut into modules, meaning the pressure can be adjusted on demand, by using all or some of the modules.

The length of the tubes that form the modules can be 10, 20, 50, 100 or 200 meters for example.

In reality, the diameter of the tubes that form the modules should be between ½ and 4 inches and preferably between ½ and 2 inches for standard vertical or horizontal wells. The diameter of the tubes is adapted to the flow of polymer for each injection well.

The aforementioned models are equipped with by-pass valves and are preferably circular in shape to reduce blockage.

The valves can be operated manually or remotely from a central control room.

The metal used for the construction of the tubes must be adapted to the brine composition and temperature according to rules that are well known to specialist Petroleum Engineers. This construction may use stainless steel 304, stainless steel 316, duplex, super duplex, Hastelloy and in some instances copper . . . .

In shore reservoirs, injection rates of water or polymer solution are between 4 and 50 $m^3$/hour in most cases.

The goal then is to build pressure reducers that work at between 4 and 50 $m^3$/hour (and even beyond that) with pressure drops of 10 to 50 bar and a minimum molecular weight degradation. This data cannot be obtained via calculation; it is therefore necessary to carry out systematic tests reservoir by reservoir to check the brine injected (which has a strong influence on viscosity), the type and concentration of polymer and derived pressure reductions, the effects of the walls, the shape of the pipes or pulsations . . . .

More precisely, for a given tube length and diameter, pumping tests determine the range of pressure and the pressure drops at which the viscosity of the polymer solution has not degraded more than 10%, preferable not more than 5%.

These tests are carried out for example with polymer solutions in reservoir brine with a 40 bars diaphragm metering pump equipped with pulsation absorber for a flow of 40 $m^3$/hour through circulating coiled tubes of 100 meters, with diameters of ½, ¾, 1, 1¼ inches made from stainless steel. These allow us to define for a given length and diameter the range of pressure and the pressure drops at which the polymer will not be substantially degraded.

By not substantially degraded, we intend a degradation in the Brookfield viscosity of the polymer in solution, at injection concentration, of less than 10% and preferably less than 5% compared to the original value.

It is also possible to use hairpin tubes but the sudden change in direction can cause supplementary polymer degradation.

An important advantage of this type of linear pressure reducer is the easy control of chokes submerged offshore, this control is limited to the opening or closing of 4 to 5 valves.

Another object of the invention then is an enhanced oil recovery installation using polymer injection that implements the linear pressure reducer, particularly on an offshore installation.

In practice, the device is positioned between the high pressure line feeding the wells with polymer solution and each wellhead.

The invention and its advantages are clearly demonstrated in the following examples, which support the accompanying drawings.

FIG. 1 is a graph showing the degradation of an acrylamide polymer (30% anionic with a molecular weight of 20 million) relative to pressure drop of a choke.

FIG. 2 is a diagram showing the sequence of modules in an enhanced oil recovery installation.

Figure 3A:
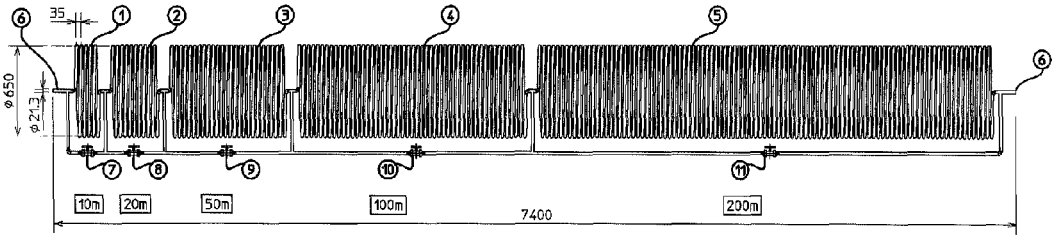
Figure 3B:
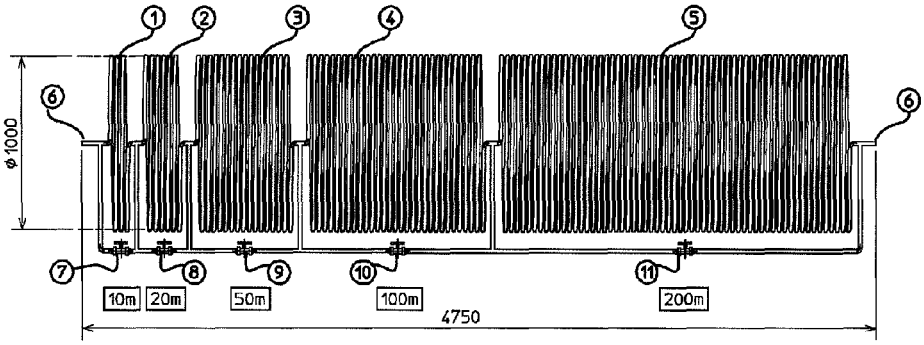

FIG. 3 contains two schematic representations of modules of 380 m in length with spiral diameters of 650 mm (3*a*) and 1000 mm (3*b*).

EXAMPLE 1

Pumping Tests

These preliminary tests were carried out with solutions of polymer in reservoir brine with a 40 bars diaphragm metering pump equipped with a pulsation absorber for a flow of 40 $m^3$/hour through circulating coiled tubes of 100 meters, with diameters of ½, ¾, 1, 1¼ inches made from stainless steel. These allow us to define for a fixed length of 100 meters and given diameter the range of pressure and the pressure drops at which the polymer will not be too degraded.

EXAMPLE 1a

Test on a Tube with a Diameter of ½" and a Length of 100 m

A synthetic brine is used that corresponds to brine typically found in the Middle East with the following composition:

| | |
|---|---|
| Na+ | 1660 ppm |
| K+ | 25 ppm |
| Ca2+ | 26 ppm |
| Mg2+ | 11 ppm |
| Cl− | 1962 ppm |
| HCO3− | 951 ppm |
| SO42− | 160 ppm |
| Fer2+ | 0 ppm |
| H2S | 30 ppm |

Polyacrylamide 3630S (70% mole of acrylamide/30% mole of acrylic acid, 20 million g/mole) 1000 ppm Initial viscosity 17.2 cP (Brookfield UL 6 rpm, 50° C.)

The diaphragm pump is connected to a 100 m long tube, with an internal diameter of 13.46 mm equipped with a pressure gauge and precision flow meter.

Each test lasts three minutes at a constant flow rate.

The results obtained are listed below.

| | Flow rate $m^3$/h | | | | |
|---|---|---|---|---|---|
| | 0 | 2.5 | 4 | 4.5 | 5 |
| Speed (m/sec) | 0 | 4.88 | 7.81 | 8.78 | 9.76 |
| Pressure drop (bar) | 0 | 4.5 | 8.4 | 9.6 | 11.3 |
| Output viscosity (cps) Brookfield UL 6 rpm | 17.2 | 16.8 | 16.7 | 16.7 | 15.9 |
| Degradation (%) | | 2.3 | 2.9 | 2.9 | 7.5 |

We observe that very high speeds near 10 m/second can be reached, with a pressure drop of 1 bar per 10 meters, without signs of substantial degradation and with flow rates of 5 $m^3$/hour for a ½ inch pipe with an interior diameter of 13.46 mm.

Degradation of 7.5% is still very low in comparison to polymer degradation in the reservoir. However, if pressure drop is high, cumulative degradation with larger widths must be considered and the flow rate be reduced or the size of the pipe increased.

EXAMPLE 1b

Test on a 1 Inch Tube (Internal Diameter of 26.63 mm, Length 100 mm)

The same brine at 50° C. was used to perform these tests in the same conditions with the following results:

| | Flow rate $m^3/h$ | | | | |
|---|---|---|---|---|---|
| | 0 | 19.5 | 31 | 35 | 38.5 |
| Speed (m/sec) | 0 | 9.7 | 15.4 | 17.4 | 19.2 |
| Pressure drop (bar) | 0 | 4 | 7.8 | 9.1 | 11.3 |
| Output viscosity (cps) Brookfield UL 6 rpm | 17.0 | 16.9 | 16.7 | 16.6 | 15.4 |
| Degradation (%) | | 0.60 | 1.76 | 2.35 | 9.41 |

This demonstrates that there may be a drop of 1 bar per 10 meters with flow rates from 19 to 38 $m^3/h$ in a 1 inch tube with an internal diameter of 26.64 mm.

These tests can be performed on any tube of different diameter.

EXAMPLE 2

Determination of the Dimensional Characteristics of the Pressure Reducer in this Invention On a well where the injection flow rate, with a solution identical to the one above, is 4 $m^3/h$ and the desired change in pressure is from 0 to 30 bar, the pressure drop per meter will be 0.084 bar and the necessary length will be 357 meters. The reducer will therefore consist of modules of 10 m, 20 m, 50 m, 100 m and 200 m; the combination of which will permit the following pressure drops:

10 m—0.84 bar
20 m—1.68 bar
10 m+20 m—2.52 bar
50 m—4.2 bar
50 m+10 m—5.04 bar
50 m+20 m—5.88 bar
50 m+20 m+10 m—6.72 bar
100 m—8.4 bar
100 m+10 m—9.24 bar . . .
200+100+50+20+10—31.92 bar The pressure drop can be modified on line by opening or closing the valves which means that each module can be short-circuited or activated. If necessary the difference in pressure can be either reduced or increased, by adding low amplitude modules of 10 to 20 meters.

FIG. 2 shows a linear pressure reducer according to the invention. This method of construction includes 5 modules identified respectively as 1 to 5 connected in series with the main injection line (6). Each module is equipped with a by-pass valve of 7 to 11 which allows the module to be short-circuited or not. The modules consist of tubes of varying length, from 10 to 200 meters.

As shown in FIG. 3, the tubes forming the module are in a spiral shape, which significantly reduces the size of the device. All the lengths can also be put in the same box with the valves in the front section.

Opening or closing the modules allows the pressure drop of the injection wells to be continuously controlled without substantially altering the viscosity of the polymer solution, all at high injection speeds.

The invention claimed is:

1. A linear pressure reducer apparatus for regulating injection pressure of a water-soluble polymer solution in injection wellheads, in an enhanced oil recovery system, comprising:

modules connected in series to a main injection pipe, each of said modules comprising tubes of identical diameter but variable length, wherein said apparatus allows variations to be made to pressure drop through adjusting the length of the tube through which the solution flows by closing or opening modules, without substantial degradation to a viscosity of the solution as the solution passes through the module.

2. The apparatus according to claim 1, characterised in that for a given tube length and diameter, pumping tests determine a pressure range and pressure drops at which the viscosity of the polymer solution does not degrade more than 10%.

3. The apparatus according to claim 1, characterised in that for a given tube length and diameter pumping, tests determine a pressure range and pressure drops at which the viscosity of the polymer solution does not degrade more than 5%.

4. The apparatus according to claim 1, characterised in that each module is equipped with a by-pass valve, and the lengths of tubes that compose the modules are 10, 20, 50, 100 or 200 meters.

5. The apparatus according to claim 1, characterised in that the diameter of the tubes composing the modules are between ½ and 4 inches and preferably between ½ and 2 inches, adapted to the flow of polymer for each injection well.

6. The apparatus according to claim 1, characterised in that the tubes composing the modules are built of material that is resistant to corrosion in conditions equal to the composition and temperature of brine, selected from stainless steel 304, stainless steel 316, duplex, super duplex and Hastelloy and in some instance copper.

7. An installation of an enhanced oil recovery system by polymer injection using the linear pressure reducer of claim 1.

8. The installation according to claim 7, characterised in that the installation is offshore.

* * * * *